United States Patent [19]

Pickens

[11] 4,117,961

[45] Oct. 3, 1978

[54] DEVICE FOR OPENING OR CLOSING A ZIPPER

[76] Inventor: Billie J. Pickens, P.O. Box 68, Wilseyville, Calif. 95257

[21] Appl. No.: 822,393

[22] Filed: Aug. 8, 1977

[51] Int. Cl.[2] ..... A47J 51/06

[52] U.S. Cl. ..... 223/111

[58] Field of Search ..... 223/111; 24/205.15 H

[56] References Cited

U.S. PATENT DOCUMENTS

| | | | |
|---|---|---|---|
| 2,908,057 | 10/1959 | Blanco | 223/111 X |
| 3,951,319 | 4/1976 | Huntress | 223/111 |

*Primary Examiner*—George H. Krizmanich

*Attorney, Agent, or Firm*—William R. Piper

[57] ABSTRACT

A device for opening or closing a zipper on a garment which is being worn and where the zipper is in an awkward place for the person to reach, such as the zipper being placed at the back of the garment. Novel adjustable means is provided that includes a spring-biased reel and cord with a hook which may be attached to the zipper handle for pulling the zipper body for closing or opening the zipper. The reel is mounted on a swingable arm pivoted to a base board attachable to a wall. The arm swings the reel into its uppermost position when the device is used for closing a zipper on the garment being worn and it swings the reel into its lowermost position when the device is used for opening the zipper.

4 Claims, 8 Drawing Figures

DEVICE FOR OPENING OR CLOSING A ZIPPER

SUMMARY OF THE INVENTION

Many garments have zippers applied to the backs of them and it is extremely difficult if not impossible for the person who wears the garment to manipulate the zipper for closing or opening it. An object of my invention is to provide a device which has a spring-biased reel mounted at one end of an arm which in turn has its other end pivoted to a base board. The base-board is secured to a wall and the arm can be swung for moving the reel into an uppermost or a lowermost position. The spring-biased reel has a cord with a hook attachable to the handle of the zipper body. When the reel is in its uppermost position, the cord may be unreeled and its hook attached to the zipper handle. The hook will then pull the handle for causing the zipper body to close the zipper. When the reel is used for opening the zipper, the arm is swung for moving the reel into its lowermost position whereupon the cord is unreeled and its hook attached to the zipper handle. A freeing of the spring-biased reel will cause it to wind up the cord and move the handle and zipper body for opening the zipper.

DESCRIPTION OF THE PREFERRED EMBODIMENT

Figure 1:
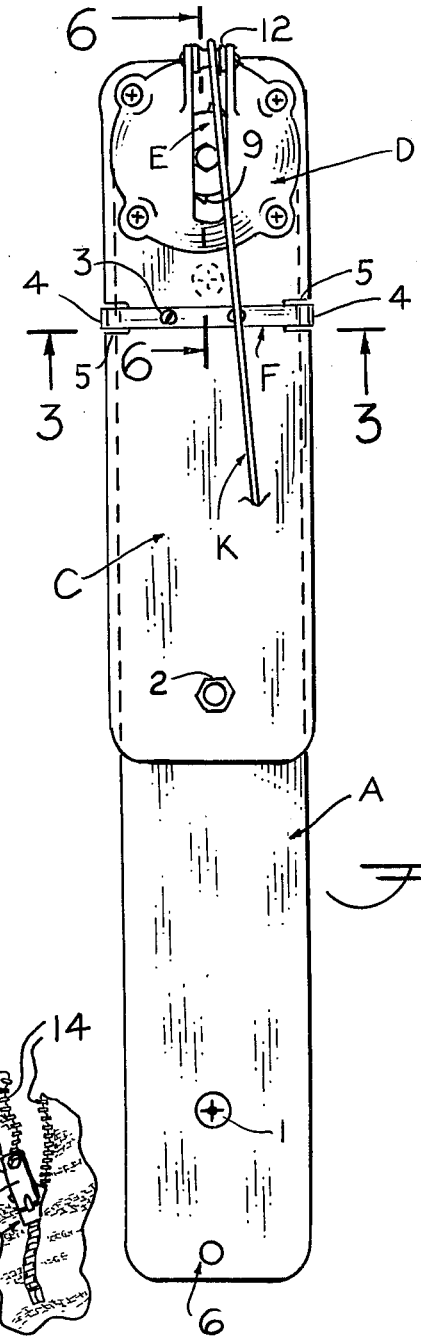
FIG. 1 is a front elevation of the device showing the base board, the swingable arm pivoted at one end to the middle of the base board and carrying the spring-biased reel at its free end.
Figure 2:
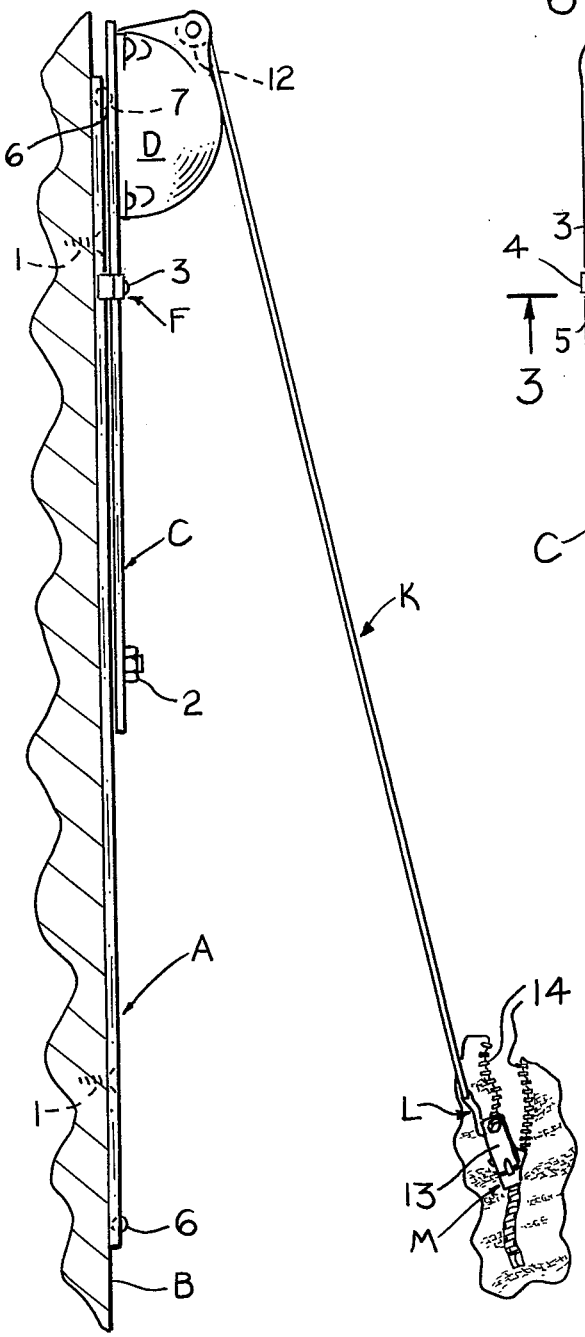
FIG. 2 is a side elevation of FIG. 1 and illustrates the base board secured to a supporting surface such as a wall.

In carrying out my invention, I provide an elongated base board indicated generally at A, in FIGS. 1 and 2. The base board may be secured to a wall B, or other supporting surface by fastening means such as screws 1. A swingable elongated arm C, is pivotally secured at one end to the base board A, by a bolt 2. The free end of said arm B, supports a housing D, which may be hemispherical in shape. This housing encloses a spring-biased reel E, see FIGS. 6 and 7.

Figure 3:
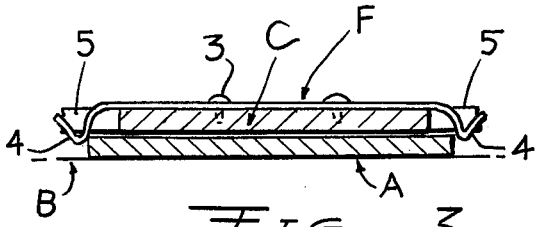
FIG. 3 is an enlarged transverse section taken along the line 3—3 of FIG. 1.
Figure 4:
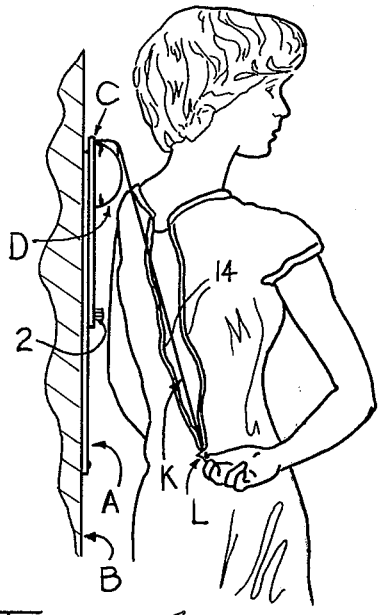
FIG. 4 is a view showing how the device is used when closing a zipper on a garment being worn.
Figure 5:
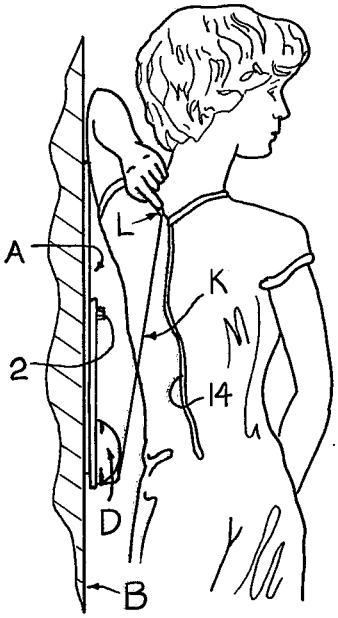
FIG. 5 is a view showing how the device is used when opening a zipper on a garment being worn.

It is possible to yieldingly hold the swingable arm C, in either one of two positions. FIGS. 1 to 3 inclusive, show the arm C with a transversely extending spring clip F, which is held in place by screws 3. The two ends of the spring clip are formed into catches 4 that enter adjacent recesses 5 provided in the edges of the swingable arm. FIG. 3 illustrates how these spring catches 4 yieldingly contact with the opposite sides of the base board A to prevent the accidental swinging of the arm C, with respect to the base board. In addition, if desired, spring biased balls 6 may be mounted in the base board A, at equal distances from the pivot bolt 2, and the undersurface of the swingable arm C may have a recess 7 which will receive one of the balls 6 when the arm C extends in an upward direction as shown in FIG. 4, and will receive the other ball 6 when the arm extends in a downward direction, as shown in FIG. 5.

Figure 6:
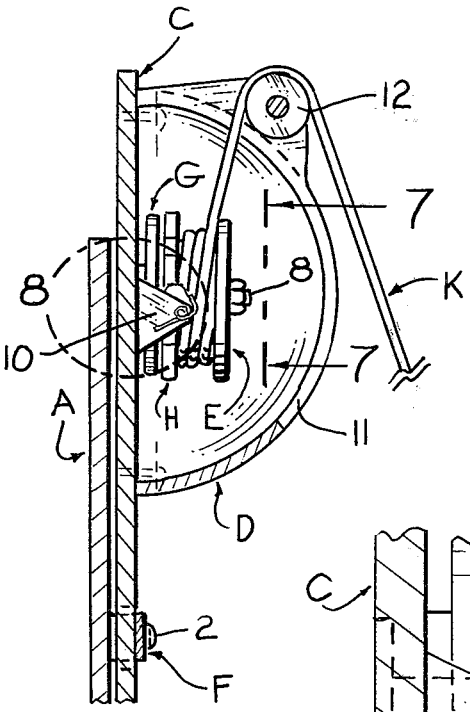
FIG. 6 is an enlarged vertical section through the housing for the spring-biased reel and shows the side view of the reel.
Figure 7:
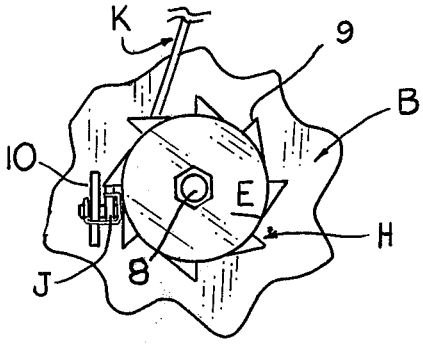
FIG. 7 is a front elevation of the reel when looking in the direction of the arrows 7—7 in FIG. 6.

A detailed description of the spring-biased reel E, and associate mechanism will now be given. FIGS. 6 and 7, illustrate the reel which is rotatably mounted on an axle 8. A torsional spring G, tends to rotate the reel in a counterclockwise direction when looking at FIG. 7. A ratchet H, is attached to the reel E, and it has teeth 9 that are engaged by a spring biased pawl J, see the detail in FIG. 8, which normally prevents the ratchet H, and reel E from rotating in a counterclockwise direction when looking at FIG. 7. The pawl J, is pivoted to a bracket 10, that is mounted on the arm C. A cord K, is wound onto the reel E, and its free end extends through a slot 11 in the housing D, as shown in FIG. 6. The cord K, is passed over an idler 12, supported by the housing and the end of the cord has a hook L, attached thereto, see FIGS. 2, 4 and 5.

FIG. 2 shows the hook L, entered through a slot in the handle 13 of a zipper body M, and this Figure illustrates the cord K pulling the zipper body for interconnecting the two toothed tracks 14 of the zipper for closing the zipper. FIG. 4, illustrates how a person can use the device for closing a zipper on a garment which is being worn. The arm C has been swung for positioning the housing D at its uppermost position. The cord K, has been extended so that the hook L may be secured to the zipper handle 13, and the spring G has been wound up so as to give it sufficient strength to pull the zipper body M for closing the zipper. To accomplish this, the person gives a quick downward pull on the cord K for causing the ratchet to swing the pawl J, into released position and before the light spring can swing the pawl back into engagement with the ratchet, the operator frees the cord K and the sring biased reel E will quickly wind up the cord and move the zipper body M for closing the zipper. As soon as this is accomplished, the hook L, is removed from the zipper handle 13.

Figure 8:
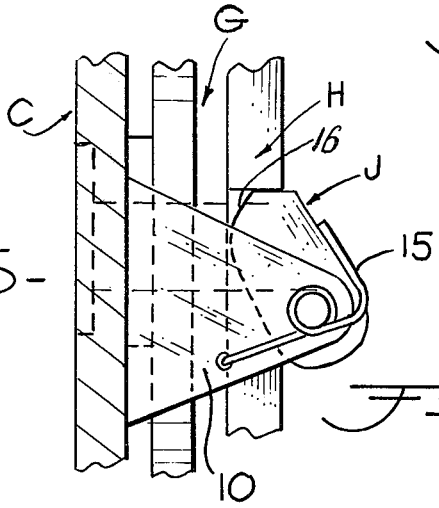
FIG. 8 is an enlarged detail of the dot-dash circled portion of FIG. 6.

It will be seen from FIG. 8, that the pawl J, has a cam-shaped portion 16. The teeth 9 on the ratchet H, are spaced close enough together that when the cord K, is unwound from the reel E, and the spring G, is tensioned by this unwinding of the cord from the reel, a quick pull on the cord will cause the ratchet tooth adjacent to the pawl, the swing the pawl into inoperative position to free the reel. The spring will instantly rotate the reel for winding the cord and the ratchet teeth will successively contact the cam portion 16 of the pawl to keep swinging the pawl into inoperative position and prevent the pawl from stopping the reel until the cord has pulled the zipper into closed position. When this happens, the weak spring 15 will swing the pawl into engaging position with the ratchet as shown in FIG. 8. Any type of quick release for the spring-biased reel E, may be used.

To open the zipper from a garment being worn, FIG. 5 shows the arm C swung to move the housing D, into its lowermost position. Again, the cord K, is unwound from the reel E a sufficient distance to permit the person wearing the garment to attach the hook L to the zipper handle 13. The unwinding of the cord from the reel will rotate the reel and wind up the spring G. A quick pull on the cord K, and an immediate release of the cord will disconnect the pawl from the ratchet and permit the spring-biased reel E to wind up the cord and move the zipper body M for opening the zipper.

I claim:

1. A device of the type described comprising:

(a) a base adapted to be secured to a vertical surface;

(b) a swingable arm pivoted at one end to said base and swingable in a vertical plane parallel to the vertical surface from a position where the arm extends upwardly from its pivot into a position where it extends downward from its pivot;

(c) a spring-biased reel mounted adjacent the free end of said arm; and (d) a cord wound on said reel and having its free end provided with a catch for removably engaging with the handle of a zipper body, said reel having a spring which is tensioned when the cord is unwound from the reel;

(e) whereby when the arm extends upwardly from the pivot, the cord can be unwound from the reel for winding the spring and the catch can be readily connected to the zipper handle on a garment being worn and the spring biased reel will pull the zipper for closing it and when the arm extends downwardly from the pivot, the cord can again be unwound from the reel for winding the spring and the catch can be readily connected to the zipper handle on the worn garment and the spring biased reel will pull the zipper for opening it.

2. The combination as set forth in claim 1: and in which (a) coacting yieldable releasable means interconnects said arm with said base for yieldingly holding said arm in its two positions.

3. The combination as set forth in claim 1: and in which (a) said base has parallel vertical side edges; and (b) said arm carries a spring clip with a catch formed at each end for releasably engaging with the side edges of said base for yieldingly holding said arm in either one of its two positions.

4. The combination as set forth in claim 1: and in which (a) a housing enclosing said spring-biased reel and being secured to said arm, said housing having a slot through which the cord from said reel passes and having a guide idler for the cord.

* * * * *